United States Patent [19]

Beltrami et al.

[11] Patent Number: 4,488,867

[45] Date of Patent: Dec. 18, 1984

[54] METHOD FOR CONTROLLING THE HEAT LOAD OF A PLANT FED WITH NATURAL GAS OF VARIABLE CALORIFIC VALUE AND DENSITY

[75] Inventors: Giovanni Beltrami, San Donato Milanese; Fulvio Formica, Sanzenone al Lambro, both of Italy

[73] Assignee: SNAM S.p.A., Milan, Italy

[21] Appl. No.: 275,024

[22] Filed: Jun. 18, 1981

[30] Foreign Application Priority Data

Jul. 4, 1980 [IT] Italy ..... 23240 A/80

[51] Int. Cl.[3] ..... F23N 1/00

[52] U.S. Cl. ..... 431/12; 431/76; 236/15 E; 374/37; 436/137

[58] Field of Search ..... 431/12, 75, 76; 73/23; 374/36, 37; 236/15 E; 422/80, 94, 95, 96, 97; 436/136, 137

[56] References Cited

U.S. PATENT DOCUMENTS

| | | | |
|---|---|---|---|
| 3,049,300 | 8/1962 | Lewis et al. | 236/15 E |
| 3,211,372 | 10/1965 | Hamilton | 236/15 E |
| 4,147,500 | 4/1979 | Karlsoen | 431/76 |

FOREIGN PATENT DOCUMENTS

| | | | |
|---|---|---|---|
| 2812605 | 9/1978 | Fed. Rep. of Germany | 431/75 |
| 8151 | 2/1980 | Netherlands | 374/37 |

*Primary Examiner*—Margaret A. Focarino

*Attorney, Agent, or Firm*—Hedman, Gibson, Costigan & Hoare

[57] ABSTRACT

A method and apparatus for controlling the heat load in a plant fed with natural gas of variable calorific value and density consisting of withdrawing a portion of gas from the feed line, burning it in a special combustion chamber, withdrawing the combustion products from the chamber, determining the quantity of free oxygen contained in the dry burnt gas and varying the volumetric throughput of the natural gas on the main line.

2 Claims, 3 Drawing Figures

METHOD FOR CONTROLLING THE HEAT LOAD OF A PLANT FED WITH NATURAL GAS OF VARIABLE CALORIFIC VALUE AND DENSITY

FIELD OF INVENTION

The invention described in this patent application relates to a new method for controlling or determining the heat load in a plant fed with natural gas when this gas is continually subject to density and calorific value variations.

It also relates to the apparatus suitable for this purpose. The method consists of withdrawing a portion of gas from the feed line, burning it in a special combustion chamber and determining the quantity of free oxygen contained in the dry burnt gas.

DESCRIPTION OF THE PRIOR ART

On the basis of the free oxygen percentage in the burnt gas, it is possible to determine the variation in the gas quality (Wobbe index) and thus in the heat load, it having been determined experimentally that a unique relationship exists between the concentration of oxygen in the burnt gas and the Wobbe index of the feed gas.

The Wobbe index, defined as the ratio of the higher calorific value to the square root of the density of the gas, is a parameter which directly expresses the heat load by means of the unique relationship $Q_t = Q_v \cdot W$, where $Q_t$ is the heat load, $Q_v$ the volumetric throughput of the gas and W the Wobbe index.

This invention relates to a method for controlling or setting the heat load of a plant fed with natural gas of variable calorific value and density, and to the apparatus suitable for this purpose.

More particularly, this invention relates to a method for controlling the heat load of a plant fed with natural gas or manufactured gas having a hydrogen content of up to 10%, and of variable quality.

It is well known that if a gas feeding a burner varies in density, its volumetric throughput varies such as to cause a variation in the heat load at the furnace in addition to an alteration in the air/gas ratio and temperature of the flame.

In order to prevent these conditions occurring, it is necessary that the volumetric throughput be suitably varied for each variation in density in such a manner that the weight throughput and thus the air/gas ratio, flame temperature and heat load remain at their set values.

Systems are known in the art for monitoring and controlling the volumetric throughput and indirectly the heat load of fuel gases when these latter are continuously subject to density variation. Usually, these systems are based on determining the temperature in the combustion chamber by suitable measuring devices such as thermocouples and pyrometers, which, on the basis of the temperature variations which they record, enable the volumetric throughput to be suitably adjusted in order to keep the conditions of the considered process constant.

However, these systems are characterised by the drawback of not being sufficiently rapid because of thermal inertia, so that there is a delay in noting the temperature variation, relative to the corresponding density variation of the feed gas.

This leads to imperfect combustion for the entire duration of the delay, and this situation worsens if the aforesaid density variations occur in rapid succession, in which case it is possible for the control system to hunt.

SUMMARY OF THE INVENTION

A method has now been found for controlling the heat load and distribution of natural gas in a rapid and accurate manner, even when this is subject to continuous density and composition variations, without suffering from the aforesaid drawbacks of the known art.

In this respect, it has been found that in the case of combustion of one, two or more natural gases of the same aliphatic series, if a certain air excess is present, the variation in the free oxygen in the dry burnt gas depends on the composition, and is directly proportional to the Wobbe index of the fed gas.

DETAILED DESCRIPTION

A series of gases (the characteristics of some of which are shown in tables 1–6) were in this respect burnt in a suitable apparatus using optimum air/fuel ratios, and the residual oxygen content was determined in the dry burnt gas. It was surprisingly found that the analysed oxygen percentages in the burnt gas and the Wobbe indices of the various gases represent a series of points which lie on a straight line if plotted on a graph in which the ordinate represents the Wobbe index and the abscissa the free oxygen content in the burnt gas.

Figure 1:
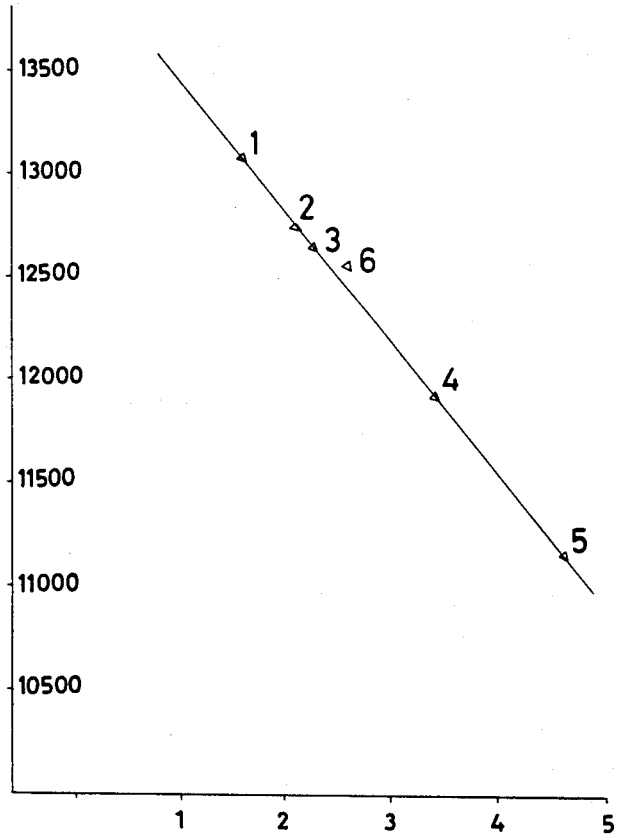
FIG. 1 is a graph in which the ordinate represents the Wobbe Index and the abscissa the free oxygen content in the burnt gas.

FIG. 1 shows the graphical representation of this straight line, in which it can be seen that points 1, 2, 3, 4 and 5 corresponding to Malossa, Typical North, Russian, Dutch natural gas, and Dutch natural gas containing 5% of nitrogen, give rise to points which lie on the straight line, only point 6, corresponding to Panigaglia natural gas, lying outside it.

The explanation for this behaviour difference is that Panigaglia gas is not a natural gas, but is a processed gas enriched in hydrogen.

Because of the fact that, as is universally known, the heat load of a gas is proportional to the Wobbe index and to the volumetric throughput in accordance with the equation $Q_t = Q_v \cdot W$ (where $Q_t$ is the heat load, $Q_v$ the volumetric throughput and W the Wobbe index), a determination of the oxygen content in the dry burnt gas can enable the said heat load to be controlled rapidly and accurately in accordance with the teaching of the present invention.

The present invention provides a method for controlling the heat load of a plant fed with natural gas by adjusting the volumetric throughput of the feed gas. The method consists of withdrawing a very small portion of gas from the main feed line, burning it in a separate combustion chamber and determining the oxygen content of the combustion products. From this oxygen content, it is possible to determine the Wobbe index for the feed gas and thus control the volumetric throughput of the gas in the main feed line at a control device downstream of said withdrawal, in order to maintain the heat load at a set value.

The apparatus necessary for determining the feed gas composition variation consists of a combustion chamber into which the air and gas arrive in such a ratio that there are no unburnt products in the burnt gas, and at constant pressure and temperature.

When a density variation in the feed gas occurs, the immediate consequence is a variation in the weight throughput and consequently a variation in the air/fuel ratio, with a variation in the free oxygen content of a burnt gas. This variation, which is analogous to that which occurs in the plant, is determined by means of an analyser which by measuring the new oxygen content of the burnt gas also determines the Wobbe index of the new gas, and thus the volumetric throughput to be fed to the plant to obtain the set heat load.

Figure 2:
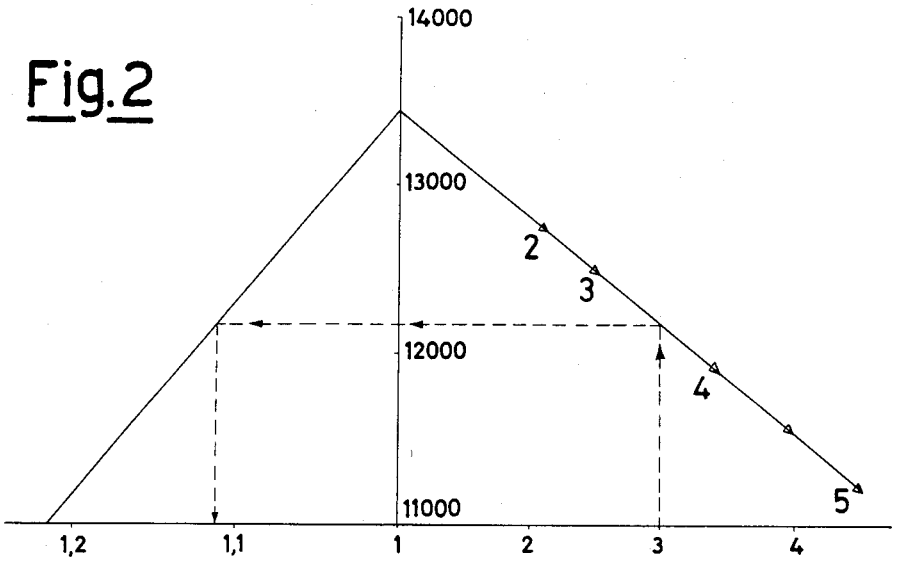
FIG. 2 is a graph showing the percentage change necessary in the volumetric throughput.

FIG. 2 is an indication of the principle of operation of the control system. The figure shows two diagrams in which the right hand one coincides with the diagram of FIG. 1, whereas the left hand diagram relates to the straight line by means of which the correction factor for the volumetric throughput is determined (this latter value being indicated on the abscissa.

The diagram instantly shows what percentage change is necessary in the volumetric throughput of the gas as a function of the Wobbe index, and thus as a function of the recorded oxygen content of the burnt gas.

Figure 3:
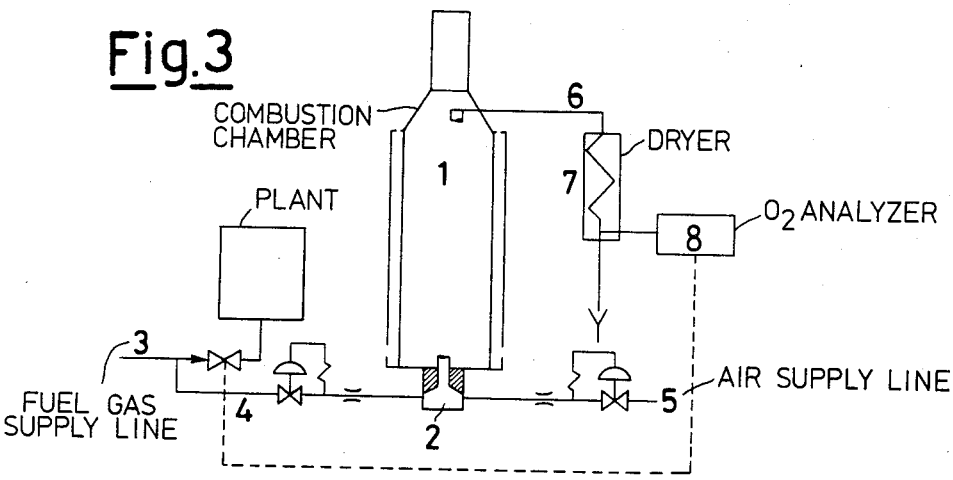
FIG. 3 is a schematic diagram of the apparatus according to the subject invention.

FIG. 3 shows one example of the monitoring apparatus. The natural gas branched from the main line 3 is fed through line 4 to the burner together with the air in line 5.

The air/gas ratio must be such that there are no unburnt products in the burnt gas. The burnt gas is taken from the combustion chamber 1 through 6, and after drying in 7 is fed to the oxygen analyser 8.

The analyser 8 is connected by devices, not shown, to the control system, which is also not shown, and which is located in the main feed line at a point downstream of said withdrawal, so that each time the analyser 8 determines a variation in the oxygen content of the burnt gas, the feed gas control system immediately opens or closes proportionally to this variation.

TABLE 1

| | | | | |
|---|---|---|---|---|
| COMPOSITION | METHANE | | 88.10 | |
| | ETHANE | | 6.60 | |
| | PROPANE | | 2.40 | |
| | N—BUTANE | | 0.45 | |
| | ISO-BUTANE | | 0.45 | |
| | N—PENTANE | | 0.15 | |
| | ISO-PENTANE | | 0.15 | |
| | NITROGEN | | 1.70 | |
| Definition | | | Malossa | |
| Origin | | | Malossa (Italy) | |
| Higher calorific value ASTM | | 0° C. 1 ATM | KCAL/NM$^3$ | 10470.84 |
| Lower calorific value ASTM | | 0° C. 1 ATM | KCAL/NM$^3$ | 9464.29 |
| Average molecular weight | | | | 18.48 |
| Absolute density | | 0° C. 1 ATM | KG/NM$^3$ | 0.82 |
| Density relative to air | | 15° C. 1 ATM | | 0.64 |
| Specific heat at constant pressure | | 15° C. 1 ATM | KCAL/KG °K. | 0.49 |
| Adiabatic index | | 15° C. 1 ATM | | 1.27 |
| Pseudocritical temperature | | | °K. | 205.35 |
| Pseudocritical pressure | | | KG/CM$^2$ | 47.29 |
| Dynamic viscosity | | 0° C. 1 ATM | 10-2POISE | 0.01 |
| Kinematic viscosity | | 0° C. 1 ATM | STOKES | 0.12 |
| Compressibility factor | | 60° F. 1 ATM | | 0.99 |
| Necessary air for combustion | | | M$^3$/M$^3$ | 10.48 |
| Wobbe index | | | KCAL/NM$^3$ | 13076.15 |

TABLE 2

| | | | | |
|---|---|---|---|---|
| COMPOSITION | METHANE | 99.20 | | |
| | ETHANE | 0.40 | | |
| | PROPANE | 0.10 | | |
| | NITROGEN | 0.30 | | |
| Definition | | | Typical north | |
| Origin | | | Ravenna (Italy) | |
| Higher calorific value ASTM | | 0° C. 1 ATM | KCAL/NM$^3$ | 9529.34 |
| Lower calorific value ASTM | | 0° C. 1 ATM | KCAL/NM$^3$ | 8581.42 |
| Average molecular weight | | | | 16.16 |
| Absolute density | | 0° C. 1 ATM | KG/NM$^3$ | 0.72 |
| Density relative to air | | 15° C. 1 ATM | | 0.55 |
| Specific heat at constant pressure | | 15° C. 1 ATM | KCAL/KG °K. | 0.52 |
| Adiabatic index | | 15° C. 1 ATM | | 1.30 |
| Pseudocritical temperature | | | °K. | 191.09 |
| Pseudocritical pressure | | | KG/CM$^2$ | 47.28 |
| Dynamic viscosity | | 0° C. 1 ATM | 10-2POISE | 0.01 |
| Kinematic viscosity | | 0° C. 1 ATM | STOKES | 0.13 |
| Compressibility factor | | 60° F. 1 ATM | | 0.99 |
| Necessary air for combustion | | | M$^3$/M$^3$ | 9.56 |
| Wobbe index | | | KCAL/NM$^3$ | 12746.77 |

TABLE 3

| | | |
|---|---|---|
| COMPOSITION | METHANE | 94.00 |

TABLE 3-continued

| | | | |
|---|---|---|---|
| | ETHANE | 2.00 | |
| | PROPANE | 2.00 | |
| | CARBON DIOXIDE | 0.50 | |
| | NITROGEN | 1.50 | |
| Definition | | Typical Russian | |
| Origin | | Russia | |
| Higher calorific value ASTM | 0° C. 1 ATM | KCAL/NM$^3$ | 9761.08 |
| Lower calorific value ASTM | 0° C. 1 ATM | KCAL/NM$^3$ | 8802.90 |
| Average molecular weight | | | 17.20 |
| Absolute density | 0° C. 1 ATM | KG/NM$^3$ | 0.76 |
| Density relative to air | 15° C. 1 ATM | | 0.59 |
| Specific heat at constant pressure | 15° C.1 ATM | KGAL/KG °K. | 0.50 |
| Adiabatic index | 15 ° C. 1 ATM | | 1.29 |
| Pseudocritical temperature | | K | 196.13 |
| Pseudocritical pressure | | KG/CM$^2$ | 47.24 |
| Dynamic viscosity | 0° C. 1 ATM | 10-2POISE | 0.01 |
| Kinematic viscosity | 0° C.1 ATM | STOKES | 0.13 |
| Compressibility factor | 60° F. 1 ATM | | 0.99 |
| Necessary air for combustion | | M$^3$/M$^3$ | 9.70 |
| Wobbe index | | KCAL/NM$^3$ | 12649.30 |

TABLE 4

| | | | | |
|---|---|---|---|---|
| COMPOSITION | METHANE | 90.00 | | |
| | ETHANE | 3.00 | | |
| | PROPANE | 1.00 | | |
| | CARBON DIOXIDE | 1.00 | | |
| | NITROGEN | 5.00 | | |
| Definition | | | Typical Dutch | |
| Origin | | | Holland | |
| Higher calorific value ASTM | | 0° C. 1 ATM | KCAL/NM$^3$ | 9307.18 |
| Lower caloric value ASTM | | 0° C. 1 ATM | KCAL/NM$^3$ | 8391.90 |
| Average molecular weight | | | | 17.62 |
| Absolute density | | 0° C. 1 ATM | KG/NM$^3$ | 0.78 |
| Density relative to air | | 15° C. 1 ATM | | 0.60 |
| Specific heat at constant pressure | | 15°C. 1 ATM | KCAL/KG °K. | 0.48 |
| Adiabatic index | | 15° C. 1 ATM | | 1.30 |
| Pseudocritical temperature | | | K | 193.79 |
| Pseudocritical pressure | | | KG/CM$^2$ | 46.99 |
| Dynamic viscosity | | 0° C. 1 ATM | 10-2POISE | 0.01 |
| Kinematic viscosity | | 0° C. 1 ATM | STROKES | 0.13 |
| Compressibility factor | | 60° F. 1 ATM | | 0.99 |
| Necessary air for combustion | | | M$^3$/M$^3$ | 9.33 |
| Wobbe index | | | KCAL/NM$^3$ | 11919.17 |

TABLE 5

| | | | | |
|---|---|---|---|---|
| COMPOSITION | METHANE | 85.50 | | |
| | ETHANE | 2.85 | | |
| | PROPANE | 0.95 | | |
| | CARBON DIOXIDE | 0.95 | | |
| | NITROGEN | 9.75 | | |
| Definition | | | Dutch + 5% NITROGEN | |
| Origin | | | Holland | |
| Higher calorific value ASTM | | 0° C. 1 ATM | KCAL/NM$^3$ | 8841.82 |
| Lower calorific value ASTM | | 0° C. 1 ATM | KCAL/NM$^3$ | 7972.31 |
| Average molecular weight | | | | 18.14 |
| Absolute density | | 0° C. 1 ATM | KG/NM$^3$ | 0.81 |
| Density relative to air | | 15° C. 1 ATM | | 0.62 |
| Specific heat at constant pressure | | 15° C. 1 ATM | KCAL/KG °K. | 0.46 |
| Adiabatic index | | 15° C. 1 ATM | | 1.30 |
| Pseudocritical temperature | | | K | 190.40 |
| Pseudocritical pressure | | | KG/CM$^2$ | 46.37 |
| Dynamic viscosity | | 0° C. 1 ATM | 10-2POISE | 0.01 |
| Kinematic viscosity | | 0° C. 1 ATM | STROKES | 0.13 |
| Compressibility factor | | 60° F. 1 ATM | | 0.99 |
| Necessary air for combustion | | | M$^3$M$^3$ | 8.86 |
| Wobbe index | | | KCAL/NM$^3$ | 11160.88 |

TABLE 6

| | | |
|---|---|---|
| COMPOSITION | METHANE | 73.00 |
| | ETHANE | 12.00 |
| | PROPANE | 2.00 |

TABLE 6-continued

| | | | |
|---|---|---|---|
| | CARBON DIOXIDE | 1.50 | |
| | NITROGEN | 0.50 | |
| | CARBON MONOXIDE | 1.00 | |
| | HYDROGEN | 10.00 | |
| Definition | | Panigaglia | |
| Origin | | Libya | |
| Higher calorific value ASTM | 0° C. 1 ATM | KCAL/NM$^3$ | 9775.56 |
| Lower calorific value ASTM | 0° C. 1 ATM | KCAL/NM$^3$ | 8826.07 |
| Average molecular weight | | | 17.48 |
| Absolute density | 0° C. 1 ATM | KG/NM$^3$ | 0.78 |
| Density relative to air | 15° C. 1 ATM | | 0.60 |
| Specific heat at constant pressure | 15° C. 1 ATM | KCAL/KG °K. | 0.51 |
| Adiabatic index | 15° C. 1 ATM | | 1.28 |
| Pseudocritical temperature | | K | 193.08 |
| Pseudocritical pressure | | KG/CM$^2$ | 44.37 |
| Dynamic viscosity | 0° C. 1 ATM | 10-2POISE | 0.01 |
| Kinematic viscosity | 0° C. 1 ATM | STROKES | 0.12 |
| Compressibility factor | 60° F. 1 ATM | 0.99 | |
| Necessary air for combustion | | M$^3$/M$^3$ | 9.73 |
| Wobbe index | | KCAL/NM$^3$ | 12558.96 |

I claim:

1. In a method for controlling the heat load of a plant fed with natural gas by adjusting the volumetric through put of the feed gas in the main line connected to the plant relative to its caloric content, withdrawing a small portion of the natural gas from the main line, combining air with the withdrawn gas in an amount such that the air/gas ratio will insure that there will be no unburnt products in the withdrawn gas after being burnt, feeding the withdrawn natural gas-air mixture into a combustion chamber separate from the plant and burning the natural gas-air mixture in the chamber, withdrawing the combustion products from the chamber, measuring the oxygen content of the combustion products to determine the Wobbe index of the natural gas to provide a measure of the caloric content of the natural gas, and varying the volumetric through put of the natural gas in the main line downstream from where it was withdrawn in response to said determination to maintain the caloric content of the natural gas and thereby maintain the heat load in the plant at a set value.

2. A method as claimed in claim 1, wherein the natural gas can be manufactured gas containing up to 10% of hydrogen by volume.

* * * * *